US009922635B2

(12) United States Patent
Stewart et al.

(10) Patent No.: US 9,922,635 B2
(45) Date of Patent: Mar. 20, 2018

(54) MINIMIZING NUISANCE AUDIO IN AN INTERIOR SPACE

(71) Applicant: Lenovo (Singapore) Pte. Ltd., Singapore (SG)

(72) Inventors: Aaron Michael Stewart, Raleigh, NC (US); Rod D. Waltermann, Rougemont, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 15/085,744

(22) Filed: Mar. 30, 2016

(65) Prior Publication Data

US 2017/0287460 A1 Oct. 5, 2017

(51) Int. Cl.

| | |
|---|---|
| ***G10K 11/178*** | (2006.01) |
| ***H04R 29/00*** | (2006.01) |
| ***H04R 3/04*** | (2006.01) |

(52) U.S. Cl.

CPC ..... *G10K 11/178* (2013.01); *H04R 3/04* (2013.01); *H04R 29/001* (2013.01); *G10K 2210/12* (2013.01); *G10K 2210/3044* (2013.01)

(58) Field of Classification Search

CPC ..... G10K 11/178; G10K 2210/12; G10K 2210/3044; H04R 3/04; H04R 29/001

See application file for complete search history.

(56) References Cited

U.S. PATENT DOCUMENTS

| | | | | |
|---|---|---|---|---|
| 5,995,632 | A * | 11/1999 | Okada | F04D 29/663 381/71.14 |
| 6,188,771 | B1 * | 2/2001 | Horrall | G10K 11/175 381/73.1 |
| 7,194,094 | B2 * | 3/2007 | Horrall | G10K 11/175 381/73.1 |
| 8,041,026 | B1 * | 10/2011 | Coughlan | G10L 21/0208 379/392.01 |
| 8,107,639 | B2 * | 1/2012 | Moeller | G10K 11/175 381/104 |
| 8,761,411 | B2 * | 6/2014 | Zickmantel | G10K 11/175 381/57 |
| 2001/0021259 | A1 * | 9/2001 | Horrall | G10K 11/175 381/73.1 |
| 2013/0166076 | A1 * | 6/2013 | Karr | G05B 15/02 700/280 |
| 2014/0167653 | A1 * | 6/2014 | Chobot | H05B 37/029 315/362 |
| 2015/0382122 | A1 * | 12/2015 | El Zur | H04R 3/02 381/73.1 |
| 2016/0093282 | A1 * | 3/2016 | Moshksar | G10K 11/1786 381/71.1 |

* cited by examiner

*Primary Examiner* — Brenda Bernardi

(74) *Attorney, Agent, or Firm* — Ference & Associates LLC

(57) ABSTRACT

One embodiment provides a method, including: detecting, using one or more audio capture devices, nuisance audio; receiving, from one or more device sensors, contextual information; determining a mitigating audio signal based on the nuisance audio and contextual information; thereafter, emitting, from one or more audio source devices, mitigating audio into an interior space. Other aspects are described and claimed.

20 Claims, 3 Drawing Sheets

MINIMIZING NUISANCE AUDIO IN AN INTERIOR SPACE

BACKGROUND

The majority of the world's population now lives in metropolitan areas. When living in these large, populous places it can be difficult to escape the constant presence and noise of other human beings. The noise created by others can cause a problem in a wide variety of ways, from the inability to enjoy relaxed recreational time (e.g., watching a movie in your living room) to increased difficulty when trying to accomplish a task that requires a great deal of concentration (e.g., complex work in an office space).

Although the problem may exist outdoors in large crowds, most people are not trying to escape to peace and quiet while in a crowded environment. Thus, the effect of being unable to enjoy a quiet space is typically more pronounced indoors. For example, it may be difficult to work in an office environment when playing music or talking loudly takes place in an adjacent room. Additionally, a user may wish to create a more private and comfortable living environment within an apartment complex. Thus, the general quality of life enjoyed by most people could be greatly improved with a mechanism for reducing the effects of intrusive noises within an area.

BRIEF SUMMARY

In summary, one aspect provides a method, comprising: detecting, using one or more audio capture devices, nuisance audio; receiving, from one or more device sensors, contextual information; determining a mitigating audio signal based on the nuisance audio and contextual information; thereafter, emitting, from one or more audio source devices, mitigating audio into an interior space.

Another aspect provides an information handling device, comprising: a processor; a memory device that stores instructions executable by the processor to: detect, using one or more audio capture devices, nuisance audio; receive, from one or more devices sensors, contextual information; determine a mitigating audio signal based on the nuisance audio and contextual information; thereafter, emitting, from one or more audio source devices, mitigating audio into an interior space.

A further aspect provides a product, comprising: a storage device having code stored therewith, the code being executable by the processor and comprising: code that detects, using one or more audio capture devices, nuisance audio; code that receives, from one or more device sensors, contextual information; code that determines a mitigating audio signal based on the nuisance audio and contextual information; code that thereafter, emits, from one or more audio source devices, mitigating audio into an interior space.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
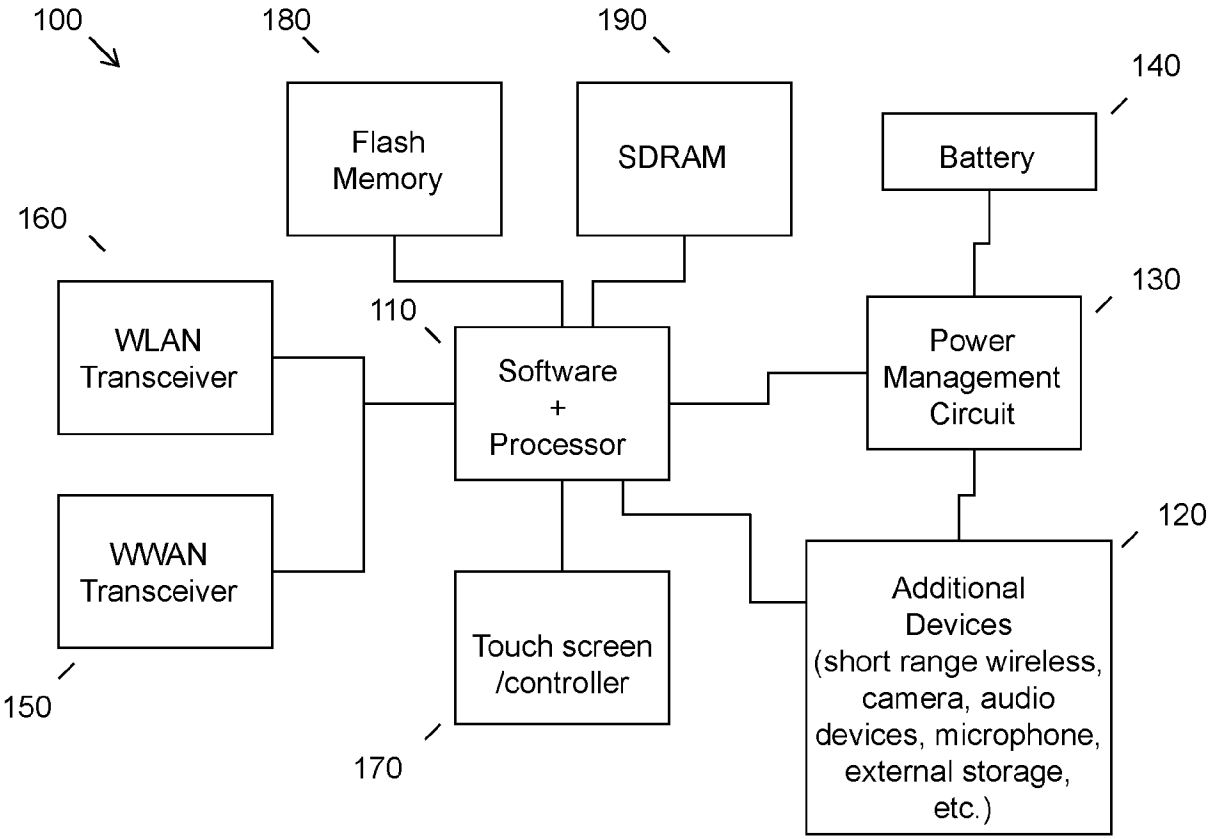
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As discussed herein, it can be difficult to focus on work or enjoy personal time in a loud environment. In the typical home and/or office space, the interior walls that separate different areas of the space are typically not sufficient auditory barriers to the eliminate the transfer of sound between spaces. This can become a major problem when each area is designed to be independent and operate in near isolated audio conditions, as is typical in most office and living spaces.

Currently some solutions exist that allow an individual to manually reduce the effects of nuisance audio, such as enabling a white noise generator to overwhelm sounds from surrounding spaces, or turning up an audio source of their own (e.g., television, music, etc.). Various other solutions for creating isolated audio environments in a given space also exist. For example, physically dampening sound with the use of special material attached to various surfaces within a room (e.g. walls, floor, and ceiling). This technique is sometimes referred to as passive dampening.

One of the more advanced methods of sound dampening is the process of generating sound a cancellation signal (e.g., from an audio output device) that is out of phase (i.e. destructive) with the offending or nuisance sound frequencies. This technique is sometimes referred to as active dampening or active noise cancellation. However, although these solutions may exist they all still have major drawbacks. For example, in passive dampening, the available space and appearance of an area may be greatly affected. With current active dampening techniques as well as the white noise solution, human intervention is required in that a person must notice the issue and then take an action to affect it (e.g., by turning on a white noise machine or activating active noise cancellation system). There are no current solutions that automatically detect a nuisance audio signal and implement a corrective action regarding nuisance noise.

Accordingly, an embodiment provides a system of one or more individual audio devices that have microphones for audible input and/or speakers for audible output. The devices themselves may be physically arrayed in a pattern relative to a respective space, or multiple spaces, allowing them to cover a large area and deliver an audible reach through spaces that may be divided or separated by walls. In a further embodiment, these audio input/output devices are intelligently meshed together via a wired or wireless network connection or any method of peer-to-peer communication. In one embodiment, the one or more audio devices may connect through a centrally networked device (e.g., server) or network application thereby enabling the full array to operate as one connected system.

The illustrated example embodiments will be best understood by reference to the figures. The following description is intended only by way of example, and simply illustrates certain example embodiments.

While various other circuits, circuitry or components may be utilized in information handling devices, with regard to smart phone and/or tablet circuitry 100, an example illustrated in FIG. 1 includes a system on a chip design found for example in tablet or other mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120) may attach to a single chip 110. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additionally, devices 120 are commonly included, e.g., audio devices such as a microphone, a speaker, etc. System 100 often includes a touch screen 170 for data input and display/rendering. System 100 also typically includes various memory devices, for example flash memory 180 and SDRAM 190.

Figure 2:
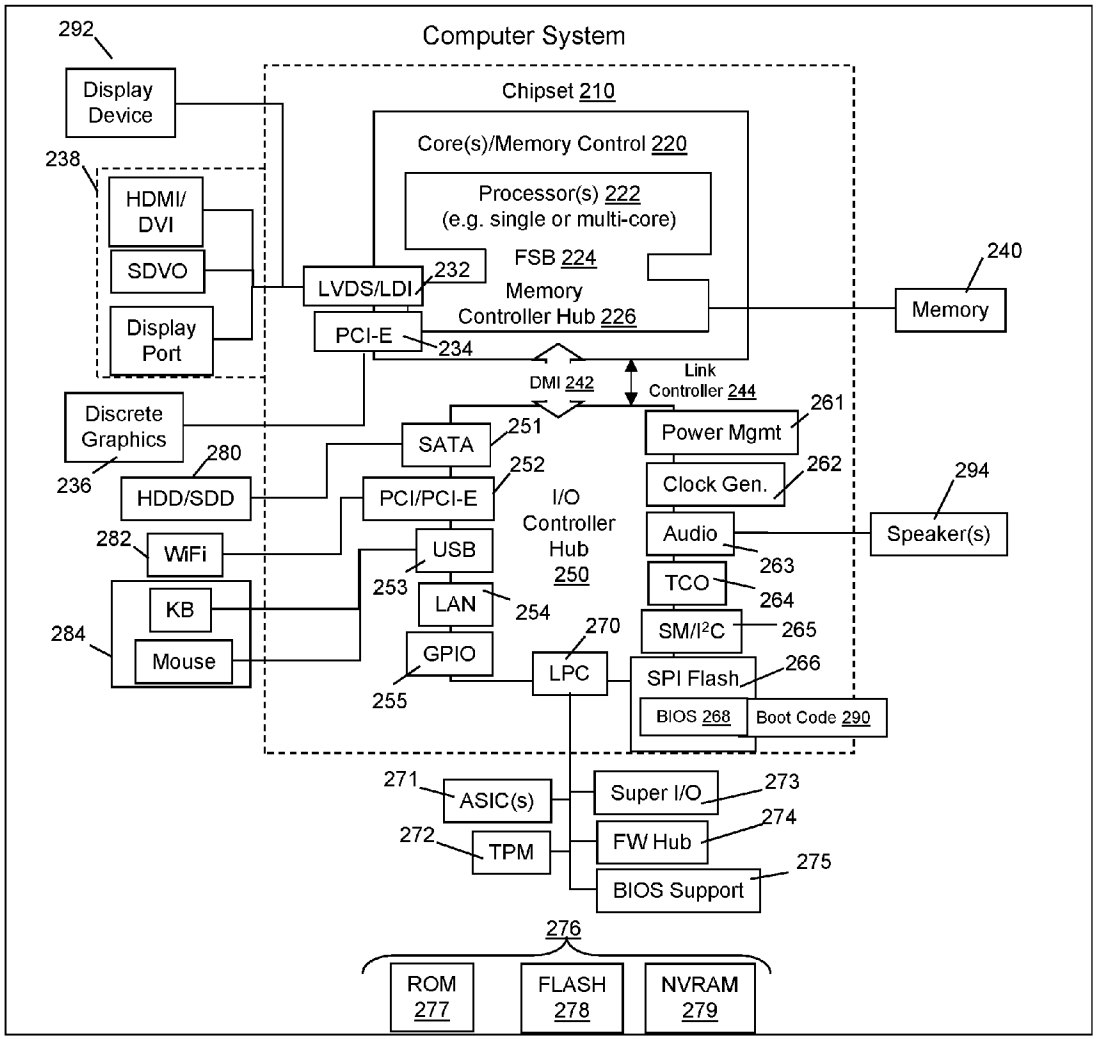
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a low voltage differential signaling (LVDS) interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Information handling device circuitry, as for example outlined in FIG. 1 or FIG. 2, may be used in devices such as tablets, smart phones, personal computer devices generally, and/or electronic devices which users may utilize to capture audio and emit audio to counter the captured audio. For example, the circuitry outlined in FIG. 1 may be implemented in a tablet or smart phone embodiment, whereas the circuitry outlined in FIG. 2 may be implemented in a personal computer embodiment.

Figure 3:
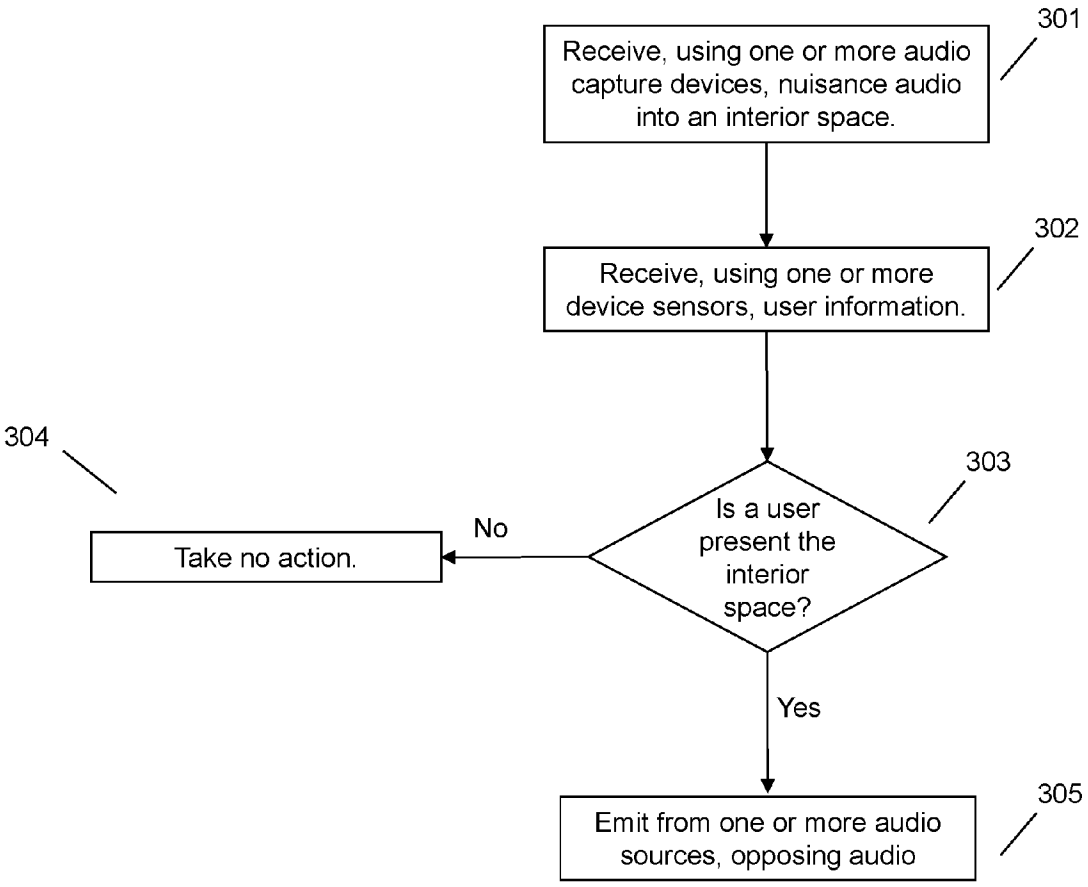
FIG. 3 illustrates an example method of minimizing nuisance audio in an interior space.

Referring now to FIG. 3, an embodiment may receive nuisance audio using one or more audio capture devices at 301. The audio may be for example, other individuals talking, using a telephone (e.g., speaker phone), a television, radio, or other media device, or generally anything that can generate a noise that may be considered inconvenient or a nuisance to a user. In one embodiment, the nuisance audio originates in an adjacent interior space (e.g., an interior space separated via wall(s) or door(s)). For example, in an office space setting, the nuisance audio may originate in an adjacent office space, such as a co-worker participating in: a conference call, a meeting, or webinar viewing.

In another embodiment, multiple sources of nuisance audio in different adjacent locations may exist. For example, if an individual lives in an apartment complex, they may have neighbors on the sides as well as above and below them. Thus, nuisance audio could be coming from above (e.g., heavy footsteps) while also coming from beside them (e.g., loud television). In this instance, an embodiment may receive nuisance audio at 301 using the one or more audio capture devices from multiple adjacent interior spaces, oriented in various directions.

In addition to nuisance audio, an embodiment may also receive user contextual information via various device sensors at 302. In an embodiment, a monitoring device having a sensor may be any device capable of monitoring activity in an interior space (e.g., contextual information). Multiple non-limiting examples of monitoring devices are discussed herein (e.g., wearable, device, environmental, user identification, etc.). For example, a wearable device (e.g., a fitness tracker, smartwatch, wristband, smart glasses or eyewear, wearable camera, tokens or jewelry, or any equivalent device) can be used to monitor an individual's physical movements or presence in a space. These non-limiting examples of wearable technology may be used individually or in combination with each other, e.g., to improve their accuracy.

In an additional or alternative embodiment, the monitoring device(s) may be environmental monitoring device(s) (e.g., a motion sensor, camera (e.g., security camera), audio capture device, infrared imaging device, room thermometer, radio-frequency identification reader and tag, short range wireless device and receiver, or any equivalent device), which can detect a user's activity within a specific space. Similar to the wearable technology, these non-limiting examples of environmental monitoring devices may be used individually or in combination with one another, for example connected via a network connection to each other.

In an even further embodiment, the monitoring device(s) may be associated with a particular piece of equipment. For example, a printer may have a monitoring device that monitors the printer activity or current status. It should be clear to one skilled in the art that these equipment monitors may be for example a network of physical objects: devices, vehicles, buildings and other items that are embedded with electronics, software applications, sensors, and network connections, thus enabling these objects to collect and exchange data. This technology may be generally referred to as the Internet of Things (IoT).

The monitoring devices discussed herein, may be used to monitor both the main room/area (i.e., where the user is located) and various adjacent areas (i.e., where the nuisance audio originates). In one embodiment, the device sensors may determine if a user is present in the main interior space (e.g., user's room/area) at 303. As a non-limiting example, an embodiment may determine information about a user's presence via wearable technology, as discussed herein, and/or light conditions in the space. Moreover, the determination at 303 may be based on audio detected by one or more audio capture devices located throughout the space, or via Application Program Interfaces (API) from various types of Internet of Things (IoT) devices. If a user is not present in the main room/area (e.g., the designated space for sound reduction), no action may be needed at 304. Stated differently, if the user is not present in a space for which protection is desired, there may be no rational for enabling devices in an effort to reduce the nuisance audio in the space.

In an embodiment, the determination may be made at 303 that a user is present in the interior space. Once a user is determined to be within the designated area/room, an embodiment may emit from one or more audio sources mitigating or opposing audio designed to reduce the effect, intensity, and/or volume of the nuisance audio. The mitigating audio may come in various forms, and the various forms may be determined using the various collected data and analysis, as discussed herein.

In one embodiment, the monitoring devices, discussed herein, may be used to determine a current activity taking place in the main room/area. For example, if a sensor determines that no light source is present, but the audio capture devices can detect breathing or snoring, an embodiment may assume the user is sleeping. In an embodiment, a fitness monitor device may determine that a user is exercising or doing some other strenuous activity. The examples of user activity discussed herein are non-limiting examples, as the monitors may be used to monitor all activities that can take place in an interior space, such as: desk work, eating, sleeping, exercising, using a telephone, having a meeting, consuming media (e.g., watching television, listening to music, etc.), reading a book, cooking, etc. Once an embodiment determines a user activity, the mitigating audio that is being, or will be, emitted may be modified based on the current activity.

The activity of users in the adjacent spaces may be monitored in order to better determine what type of activities are taking place in the adjacent area. This monitoring then allows an embodiment to better determine the type and/or style of mitigating audio to emit. In one embodiment, user information may be collected on all relevant individuals (e.g., the user and those individuals in adjacent spaces), and may be aggregated regarding user presence and activities. Although the information/data may be sensed from different devices, an embodiment may transmit or receive the collected information at a centralized device (e.g., an information handling device such as a computer, server, or mobile device) via a network connected device or a networked application.

Once an embodiment has collected enough information to determine that both a user is present in the main room/area and nuisance audio is detected, an embodiment proceeds to select a type of mitigating audio to respond with. In one embodiment, the mitigating audio may be audio that the user in the main room/area is enjoying (e.g., a television program, streaming radio broadcast, etc.). Because the desired intent of the user is to enjoy their media, an embodiment may increase the volume of that media (i.e., the mitigating audio) in an effort to reduce the effect of the nuisance audio. In another embodiment, the mitigating audio may be in the form of white noise, pink noise, brownian noise, blue noise, violet noise, grey noise, and other soothing audio sounds (e.g., rain storms, ocean waves, fans, whales, birds, etc.). Thus, an embodiment may utilize the effects of a more preferred sound to override or drown out the nuisance audio.

Additionally or alternatively, an embodiment may utilize mitigating audio that is generated specifically based on the nuisance audio. By way of example, an embodiment may use active noise cancellation, which is a tool for reducing unwanted sound by the addition of a second sound specifically designed to cancel the first. Active noise cancellation may be 1-dimensional or 3-dimensional depending on the characteristics of the main area/room that is being protected. Thus, an embodiment may identify the phase of the nuisance audio that is received at the one or more audio capture devices, and generate mitigating audio which comprises audio having inverted phase form the nuisance audio.

Multiple specific example embodiments will now be discussed in order to further clarify the function of the various embodiments described herein. For example, one embodiment may utilize a plurality of networked connected (e.g., Wi-Fi, Ethernet, short-range wireless communication, etc.) audio input/output devices which can independently sense audio input (e.g., nuisance audio) and control audio output (e.g., mitigating audio). An embodiment may also establish a direction and identify the various frequencies of audio signals detected (e.g., nuisance audio) incident at the device. An embodiment may then utilize the output devices to emit white noise at varying coordinated levels across the plurality of output devices. Additionally, or alternatively, an embodiment may emit audio for active noise cancellation via issuing signals that are out of phase with specific audio signals that are determined to be emanating from a source other than the respective audio input/output devices in a direction mitigating that of the offending audio signal.

By way of specific example, an embodiment may detect a first user (A) to be in room X. It may additionally detect that the lights in room X are off and that ambient sound levels detected are low. It may also, substantially simultaneously, be detected that a second user (B) is detected in a room adjacent to room X (room Y) in which the lights are on and the second user (B) is actively on a teleconference thereby generating sound. In this example scenario, an embodiment may emit white noise and/or active noise cancellation measures to protect room X to help keep it quiet for first user (A).

By way of further specific example, an embodiment may adjust desirable audio due (e.g., media a user wishes to enjoy) based on the detected nuisance audio. For example, a first user (A) and second user (B) are in room X watching a video with associated audio on a television. Additionally, the noise of a dishwasher from a space adjacent to room X is detected. The audio mix (e.g., the audio associated with the television) in room X will be automatically adjusted (e.g., increased) to compensate for added noise from the dishwasher. Additionally or alternatively, active noise cancellation measures will be directed toward the source of the dishwasher noise.

In an additional specific example, an embodiment may cancel out noise between overlapping audio sources. For example, a first user (A) is located in room X listening to music, while a second user (B) is in an adjacent room to room X (room Y) listening to different music. Thus, an embodiment may direct active noise cancellation in the direction of the wall separating the rooms of the first user (A) and the second user (B) using trajectories and frequencies least likely to interfere with the audio intended by the occupants of each respective space.

Accordingly, as illustrated by the example embodiments and figures herein, an embodiment provides a method of receiving, using one or more audio capture devise, nuisance audio into an interior space. An additional embodiment may also receive, using one or more devices sensors, user information relating to a user activity in the various monitored spaces. Based on the gathered information, an embodiment may then emit from one or more audio sources, mitigating audio, wherein the mitigating audio is intended to limit or remove the presence of the nuisance audio from the protected interior space(s).

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, an electronic, magnetic, optical, electromagnetic, infrared, or semiconductor system, apparatus, or device, or any suitable combination of the foregoing. More specific examples of a storage medium would include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a general purpose information handling device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A method, comprising:

detecting, using one or more audio capture devices, nuisance audio within at least one of a plurality of spaces;

detecting at least one user within another of the plurality of spaces;

receiving, from one or more device sensors, contextual information, wherein the contextual information comprises information related to a presence of the at least one user and additional information related to an activity of the at least one user;

determining a mitigating audio action based on the nuisance audio, the detected user, and the contextual information;

thereafter, emitting, from one or more audio source devices, mitigating audio based upon the determined mitigating audio action into another of the plurality of spaces.

2. The method of claim 1, wherein the mitigating audio comprises at least one of white noise, pink noise, brownian noise, blue noise, violet noise, grey noise, active noise cancellation, and audio associated with media being consumed by a user.

3. The method of claim 1, further comprising:

identifying the phase of the nuisance audio;

wherein the mitigating audio comprises audio having inverted phase from the nuisance audio.

4. The method of claim 1, wherein the contextual information comprises user information, wherein the mitigating audio is modified based on the user information.

5. The method of claim 4, further comprising:

identifying, based on the user information, a current activity associated with at least one of: the interior space and the at least one adjacent interior space;

wherein the mitigating audio is modified based on the current activity.

6. The method of claim 4, wherein the one or more device sensors detect data selected from the group consisting of: user presence data, user activity data, light condition data, noise type data, and noise level data.

7. The method of claim 4, wherein the modifying of the mitigating audio comprises terminating the emitting of the mitigating audio if no user is detected.

8. The method of claim 4, wherein the modifying of the mitigating audio comprises: adjusting the type of mitigating audio being emitted, wherein the adjustment is selected from the group consisting of: emitting white noise, emitting active noise cancellation, and emitting both white noise and active noise cancellation.

9. The method of claim 4, wherein the device sensors comprise a device sensor selected from the group consisting of: an equipment monitoring device, an environmental monitoring device, and a user monitoring device.

10. The method of claim 1, wherein the one or more audio capture devices and the one or more audio source devices communicate over a network.

11. An information handling device, comprising:

a processor;

a memory device that stores instructions executable by the processor to:

detect, using one or more audio capture devices, nuisance audio within at least one of a plurality of spaces;

detect at least one user within another of the plurality of spaces;

receiving, from one or more device sensors, contextual information, wherein the contextual information comprises information related to a presence of the at least one user and additional information related to an activity of the at least one user;

determine a mitigating audio action based on the nuisance audio, the detected user, and the contextual information;

thereafter, emitting, from one or more audio source devices, mitigating audio based upon the determined mitigating audio signal into another of the plurality of spaces.

12. The information handling device of claim 11, wherein the mitigating audio comprises at least one of white noise, pink noise, brownian noise, blue noise, violet noise, grey noise, active noise cancellation, and audio associated with media being consumed by a user.

13. The information handling device of claim 11, wherein the instructions are further executable by the processor to:

identify the phase of the nuisance audio;

wherein the mitigating audio comprises audio having inverted phase from the nuisance audio.

14. The information handling device of claim 11, wherein the contextual information comprises user information, wherein the opposing audio is modified based on the user information.

15. The information handling device of claim 14, wherein the instructions are further executable by the processor to:

identify, based on the user information, a current activity associated with at least one of: the interior space and the at least one adjacent interior space;

wherein the mitigating audio is modified based on the current activity.

16. The information handling device of claim 14, wherein the one or more device sensors detect data selected from the group consisting of: user presence data, user activity data, light condition data, noise type data, and noise level data.

17. The information handling device of claim 14, wherein the modifying of the mitigating audio comprises terminating the emitting of the mitigating audio if no user is detected.

18. The information handling device of claim 14, wherein the modifying of the mitigating audio comprises: adjusting the type of mitigating audio being emitted, wherein the adjustment is selected from the group consisting of: adjusting a volume level of an audio output device, emitting white noise, emitting active noise cancellation, and emitting both white noise and active noise cancellation.

19. The method of claim 14, wherein the device sensors comprise a device sensor selected from the group consisting of: an equipment monitoring device, an environmental monitoring device, and a user monitoring device.

20. A product, comprising:

a storage device having code stored therewith, the code being executable by the processor and comprising:

code that detects, using one or more audio capture devices, nuisance audio within at least one of a plurality of spaces;

code that detects at least one user within another of the plurality of spaces;

code that receives, from one or more device sensors, contextual information, wherein the contextual information comprises information related to a presence of the at least one user and additional information related to an activity of the at least one user;

code that determines a mitigating audio action based on the nuisance audio, the detected user, and the contextual information;

code that thereafter, emits, from one or more audio source devices, mitigating audio based upon the determined mitigating audio signal into another of the plurality of spaces.

* * * * *